US010251418B2

(12) United States Patent
Gielniewski

(10) Patent No.: US 10,251,418 B2
(45) Date of Patent: Apr. 9, 2019

(54) INTERMEDIATE HOPPER IN TOBACCO INDUSTRY APPARATUS FOR VERTICAL CONVEYING OF MASS-FLOW OR ROD-LIKE ARTICLES, FEEDING APPARATUS FOR FEEDING WITH TOBACCO INDUSTRY ARTICLES, AND APPARATUS FOR EMPTYING OF TRAY FILLED WITH TOBACCO INDUSTRY ARTICLES

(71) Applicant: International Tobacco Machinery Poland Sp. z o. o., Radom (PL)

(72) Inventor: Adam Gielniewski, Radom (PL)

(73) Assignee: International Tobacco Machinery Poland Sp. z o. o., Radom (PL)

( * ) Notice: Subject to any disclaimer, the term of this patent is extended or adjusted under 35 U.S.C. 154(b) by 0 days.

(21) Appl. No.: 15/703,683

(22) Filed: Sep. 13, 2017

(65) Prior Publication Data

US 2018/0098565 A1 Apr. 12, 2018

(30) Foreign Application Priority Data

Oct. 7, 2016 (EP) ..... 16192923

(51) Int. Cl.
*A24C 5/32* (2006.01)
*A24C 5/34* (2006.01)
(Continued)

(52) U.S. Cl.
CPC ..... *A24C 5/325* (2013.01); *A24C 5/34* (2013.01); *A24C 5/352* (2013.01); *A24C 5/356* (2013.01); *A24C 5/395* (2013.01)

(58) Field of Classification Search
CPC ..... A24C 5/325; A24C 5/34; A24C 5/352; A24C 5/395; A24C 5/356; A24C 5/358
See application file for complete search history.

(56) References Cited

U.S. PATENT DOCUMENTS 3,298,549 A 1/1967 Schmermund
4,303,366 A 12/1981 Hinchcliffe et al.
(Continued)

FOREIGN PATENT DOCUMENTS

EP 1 952 705 A2 8/2008
EP 2 108 271 A1 10/2009
(Continued)

*Primary Examiner* — Michael H. Wilson
*Assistant Examiner* — Dionne W. Mayes
(74) *Attorney, Agent, or Firm* — Oppedahl Patent Law Firm LLC

(57) ABSTRACT

An intermediate hopper (30) in a tobacco industry apparatus (1) for vertical conveying of a mass-flow of rod-like articles (R) comprising sidewalls (31, 32) and multiple partitions (34) partitioning the intermediate hopper (30) into vertical channels (35, 36) which are adapted to receive the rod-like articles (R) from above, whereas the intermediate hopper (30) is provided with a movable transferring element (37) being slidable relative to the partitions (34) of the intermediate hopper (30), in addition, the transferring element (37) is built of supporting plates (35A, 36A) which support the mass-flow of the rod-like articles (R) in the vertical channels (35, 36) of the intermediate hopper (30) above the supporting plates (35A, 36A), whereas the supporting plates (35A, 36A) are adapted to move downwards (A) within the vertical channels (35, 36) and to move upwards (C) outside the vertical channels (35, 36), in addition, the supporting plates (35A, 36A) are adapted to be inserted (D) into the channels (35, 36) in the area of the channel inlets (35C, 36C) and to be pulled out (B) of the vertical channels (35, 36) in the area of the channel outlets (35E, 36E), characterized in that at least the outermost supporting plate (35A) of the transferring element (37) is adapted to make a movement in the transverse direction to the direction of movement of the other supporting plates (36A). The object of the application is also a feeding apparatus for the feeding with the rod-like articles
(Continued)

Figure 1:
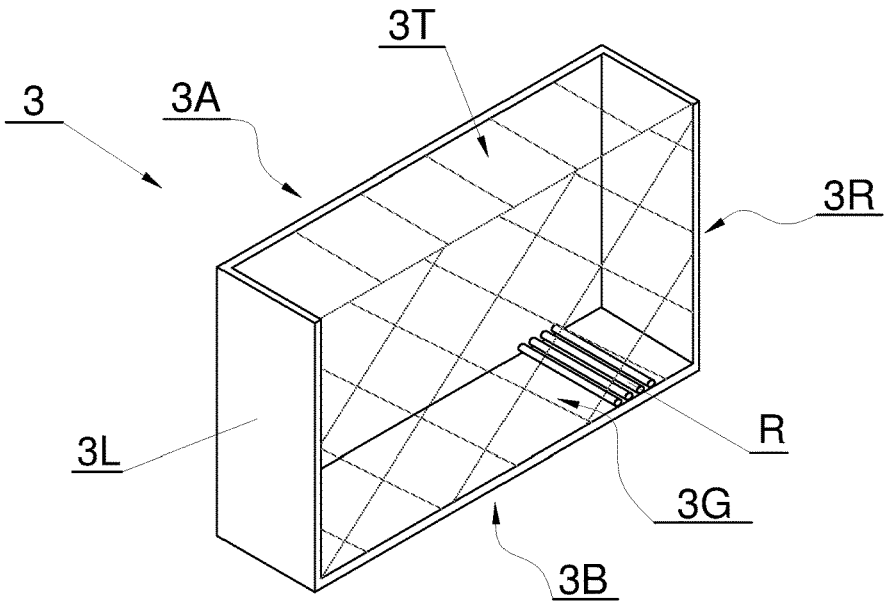

of the tobacco industry, and an apparatus for emptying of a tray filled with the tobacco industry articles.

10 Claims, 15 Drawing Sheets

(51) Int. Cl.

| | |
|---|---|
| ***A24C 5/352*** | (2006.01) |
| ***A24C 5/356*** | (2006.01) |
| *A24C 5/39* | (2006.01) |

(56) References Cited

U.S. PATENT DOCUMENTS

| | | | | |
|---|---|---|---|---|
| 4,365,703 | A | 12/1982 | Hinchcliffe et al. | |
| 2008/0181754 | A1* | 7/2008 | Budny et al. ..... | A24C 5/356<br>414/295 |

FOREIGN PATENT DOCUMENTS

| | | | |
|---|---|---|---|
| WO | 2008/020775 | A1 | 2/2008 |
| WO | 2009/145651 | A1 | 12/2009 |

* cited by examiner

INTERMEDIATE HOPPER IN TOBACCO INDUSTRY APPARATUS FOR VERTICAL CONVEYING OF MASS-FLOW OR ROD-LIKE ARTICLES, FEEDING APPARATUS FOR FEEDING WITH TOBACCO INDUSTRY ARTICLES, AND APPARATUS FOR EMPTYING OF TRAY FILLED WITH TOBACCO INDUSTRY ARTICLES

The object of the invention is an intermediate hopper in a tobacco industry apparatus for vertical conveying of the mass-flow of rod-like articles, a feeding apparatus for the feeding with tobacco industry articles, and an apparatus for emptying of a tray filled with the tobacco industry articles.

Tobacco industry's factories manufacture various articles for smoking. Both finished and semi-finished products made at successive production stages may be jointly referred to as rod-like articles which may be transported on conveyors or in trays. Plastic trays which are used for all types of rod-like articles, among others for cigarettes, cigarillos, cigars and filter material rods, are commonly used in the tobacco industry. Plastic trays have the shape of a cuboid without two adjacent walls, i.e. these are trays having four walls. Plastic trays are rigid and are used for temporary storage and transport of rod-like articles on the premises of tobacco factories. The rod-like articles stored in the trays are emptied in order to deliver them in the form of a mass-flow to machines on which the process operations related to the manufacturing of articles for smoking are performed. A method of emptying of for-wall trays is known from the patent EP 2079327 B1. The rod-like articles are transferred to an intermediate hopper and then fed to a discharging channel after sliding open a multi-element damper in the direction parallel to the axis of the articles collected in the intermediate hopper. In the case of long articles there is a risk of occurrence of creases on lateral surfaces of the articles situated in the lowest layer, i.e. lying directly on the damper. It happens due to the pressure of the articles lying in higher layers and the long distance which the damper has to cover before releasing the articles into the discharging channel. This invention solves the problem of tray emptying and at the same time allows avoiding the damage to the rod-like articles, and ensures an uninterrupted mass-flow of the rod-like articles.

EP 1952705 discloses discharge hopper and method of discharging shaft trays filled with rod-shaped products.

The object of the invention is an intermediate hopper in a tobacco industry apparatus for vertical conveying of a mass-flow of rod-like articles comprising sidewalls and multiple partitions partitioning the intermediate hopper into vertical channels which are adapted to receive the rod-like articles from above, whereas the intermediate hopper is provided with a movable transferring element being slidable relative to the partitions of the intermediate hopper, in addition, the transferring element is built of supporting plates which support the mass-flow of the rod-like articles in vertical channels of the intermediate hopper above the supporting plates, whereas the supporting plates are adapted to move downwards within the vertical channels and to move upwards outside the vertical channels, the supporting plates being further adapted to be inserted into the channels in the area of channel inlets and to be pulled out of the vertical channels in the area of channel outlets. The intermediate hopper according to the invention is further characterised in that at least the outermost supporting plate of the transferring element is adapted to make a movement in the direction transverse to the direction of movement of the other supporting plates.

The intermediate hopper according to the invention is further characterised in that the outermost supporting plate of the outermost vertical channel is slidable in at least two directions relative to the other supporting plates of the transferring element.

The intermediate hopper according to the invention is further characterised in that in the inlets of the vertical channels additional partitions are situated, whereas between the other supporting plates of the transferring element situated in the same channel there is a slot receiving the additional partitions.

The intermediate hopper according to the invention is further characterised in that the outermost vertical channel of the intermediate hopper has a smaller width than any of the other vertical channels of the intermediate hopper.

The intermediate hopper according to the invention is further characterised in that the outermost vertical channel of the intermediate hopper has a greater width than any of the other vertical channels of the intermediate hopper.

The intermediate hopper according to the invention is further characterised in that the outermost channel of the intermediate hopper has a width equal to the width of the other channels of the intermediate hopper.

The object of the invention is further a feeding apparatus for the feeding with the rod-like articles of the tobacco industry in a tobacco industry apparatus for vertical conveying of a mass-flow of the rod-like articles comprising: an intermediate hopper comprising sidewalls and multiple partitions partitioning the intermediate hopper into vertical channels which are adapted to receive the rod-like articles from above, whereas the intermediate hopper is provided with a movable transferring element being slidable relative to the partitions of the intermediate hopper, in addition, the transferring element is built of supporting plates which support the mass-flow of the rod-like articles in the vertical channels of the intermediate hopper above the supporting plates, whereas the supporting plates are adapted to move downwards within the channels and to move upwards outside the channels, the supporting plates being further adapted to be inserted into the channels in the area of the channel inlets and to be pulled out of the channels in the area of the channel outlets, whereas at least one supporting plate is adapted to make a movement in the transverse direction to the direction of movement of the other supporting plates, the apparatus being further provided with a discharging conveyor to discharge the mass-flow of the rod-like articles from the vertical channels of the intermediate hopper, a tape to close and open the outlets of the channels of the intermediate hopper and a chute having a flow connection with the discharging conveyor, the chute being slidable and adapted to receive the mass-flow of the rod-like articles from the outlets of the channels of the intermediate hopper. The feeding apparatus according to the invention is further characterised in that the outermost supporting plate of the outermost vertical channel of the intermediate store is adapted so that it slides open in the direction corresponding to the direction of discharge of the mass-flow of the rod-like articles by the discharging conveyor from the intermediate hopper.

The feeding apparatus according to the invention is further characterised in that the outermost supporting plate of the outermost vertical channel of the intermediate hopper is slidable in at least two directions relative to the other supporting plates of the transferring element.

The feeding apparatus according to the invention is further characterised in that the plates supporting the mass-flow of the rod-like articles in the other vertical channels are adapted so that they slide open in the perpendicular direction to the direction of discharge of the mass-flow of the rod-like articles from the intermediate hopper.

The object of the invention is also an apparatus for emptying of a tray filled with rod-like articles of the tobacco industry comprising: a filled tray station, a filled tray lifting unit, a turning unit, a filled tray emptying station, an empty tray station. The tray emptying apparatus according to the invention is also characterised in that the filled tray emptying station is provided with a feeding apparatus according to the object of this invention.

The apparatus according to the invention facilitates a fast start of the delivery of the rod-like articles which are to join the mass-flow of the rod-like articles coming out of the filled tray emptying machine. The operation of the element releasing the rod-like articles from the outermost channel of the intermediate hopper does not adversely affect the quality of the rod-like articles.

Figure 2:
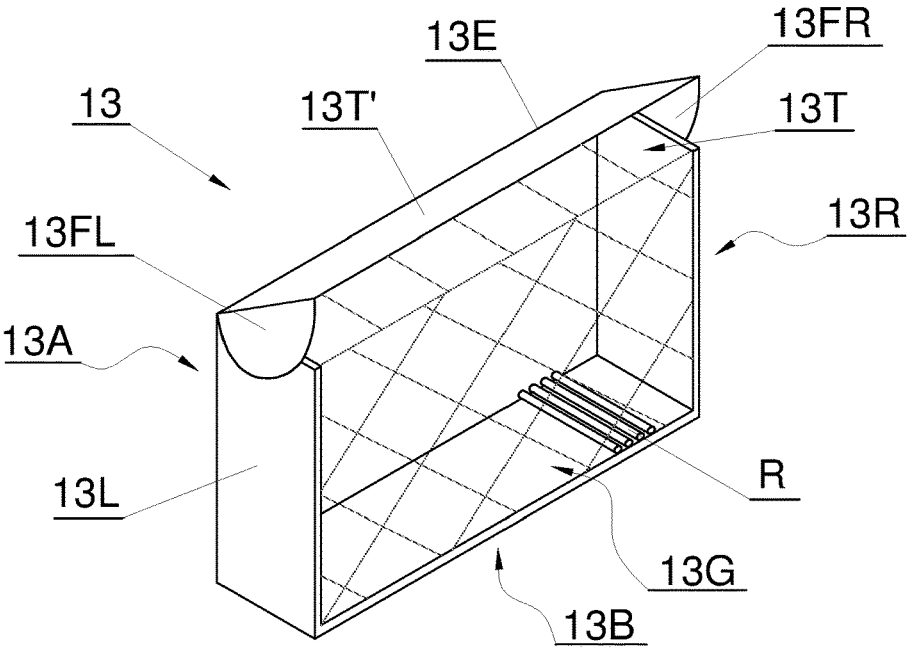
Figure 2A:
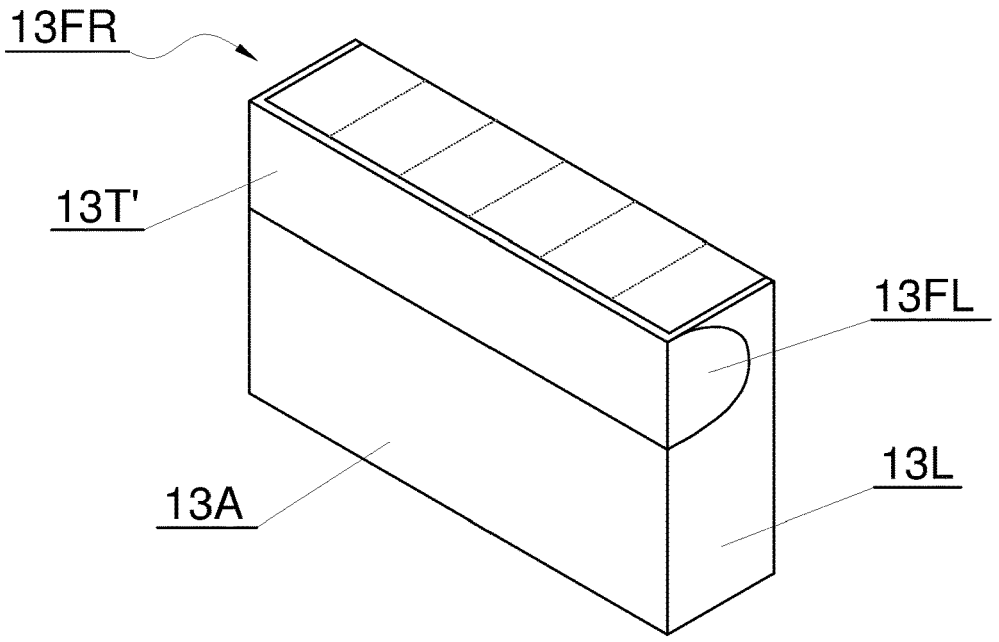
Figure 2B:
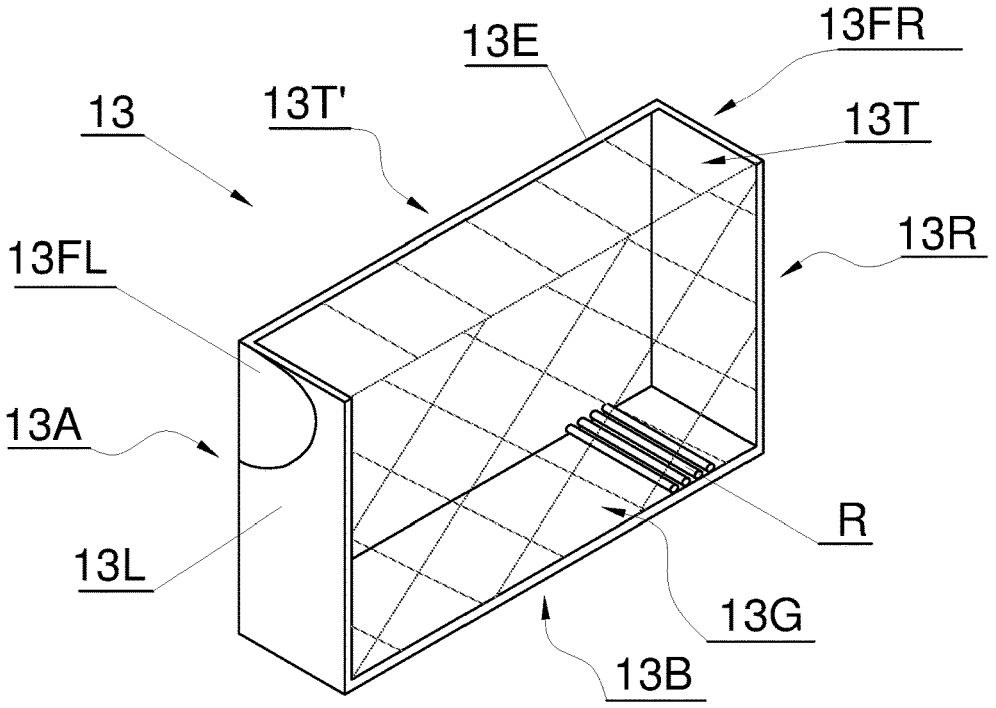
Figure 3:
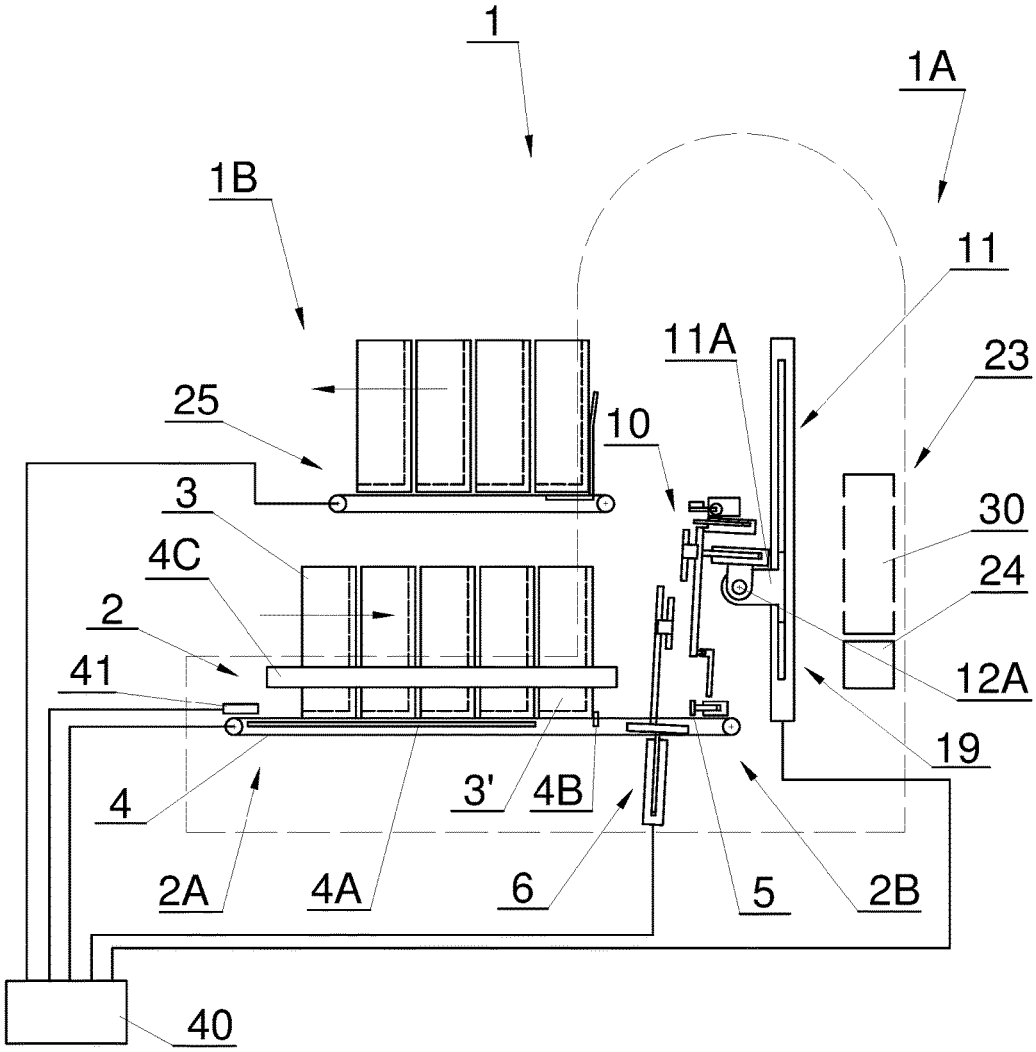
Figure 4:
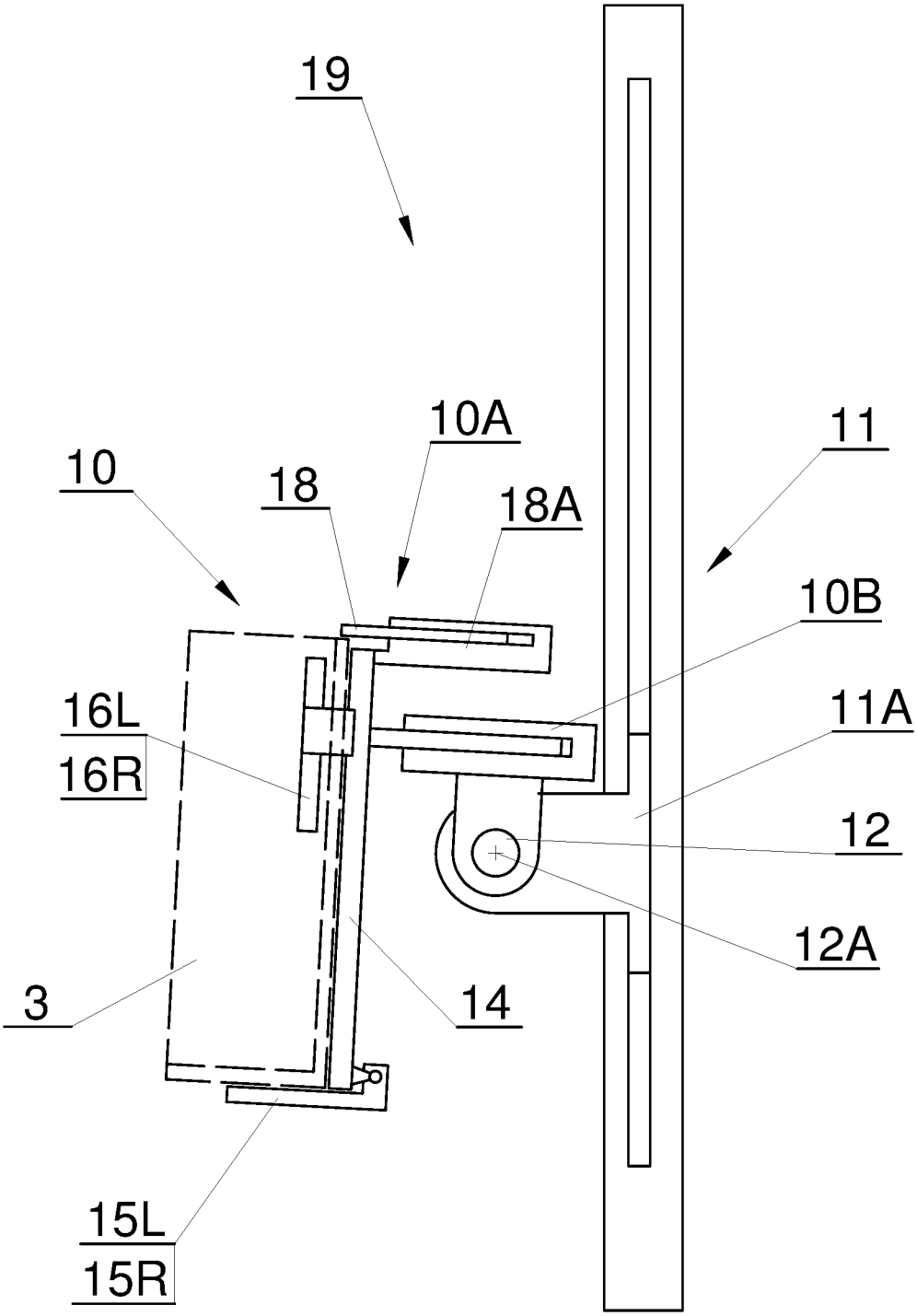
Figure 5:
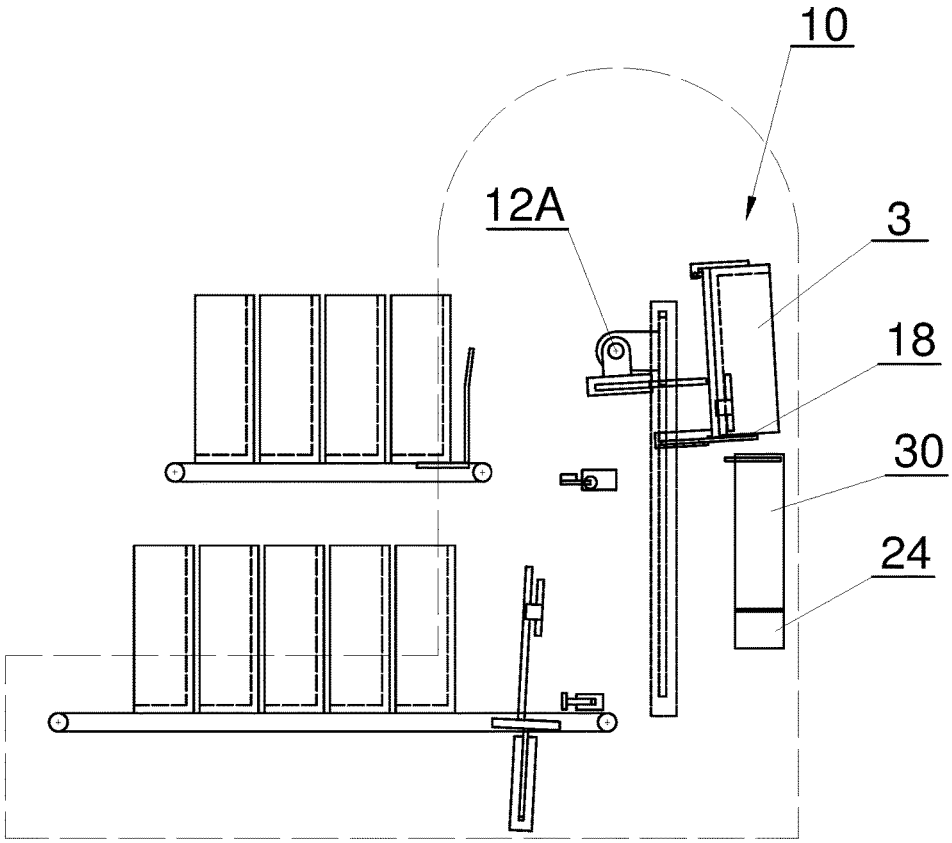
Figure 6:
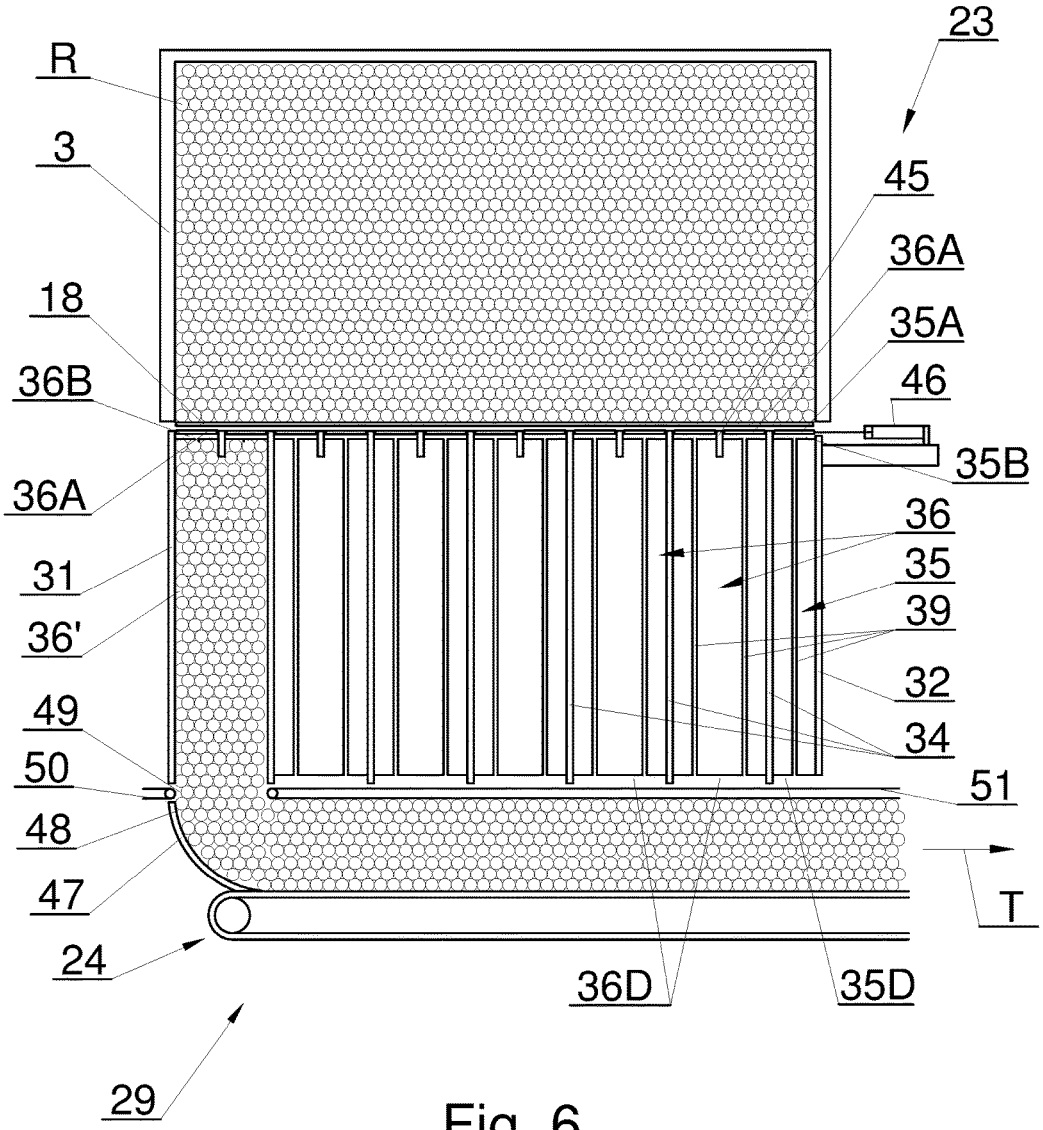
Figure 7:
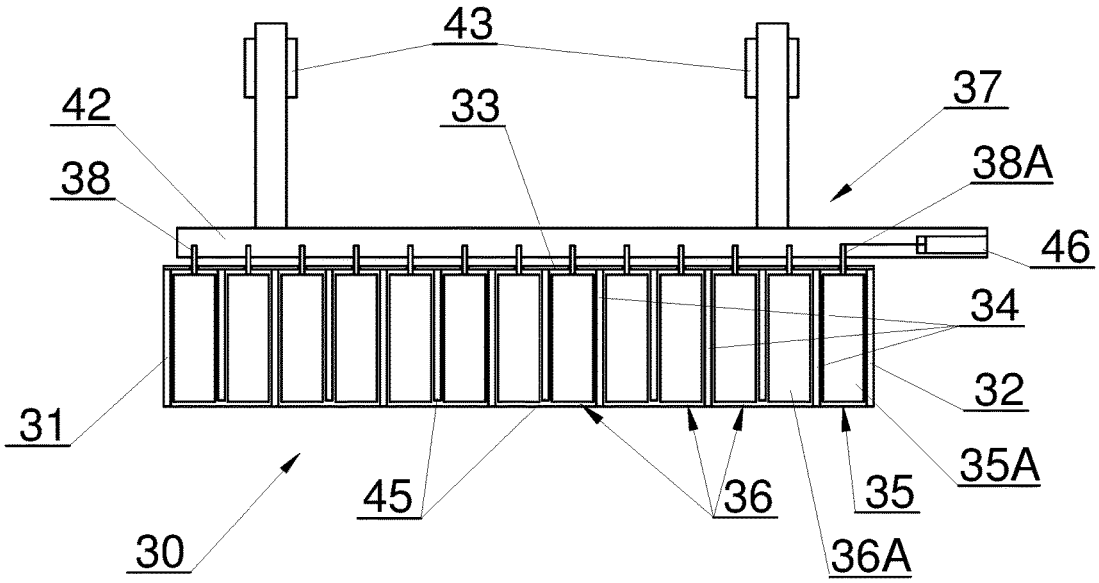
Figure 8:
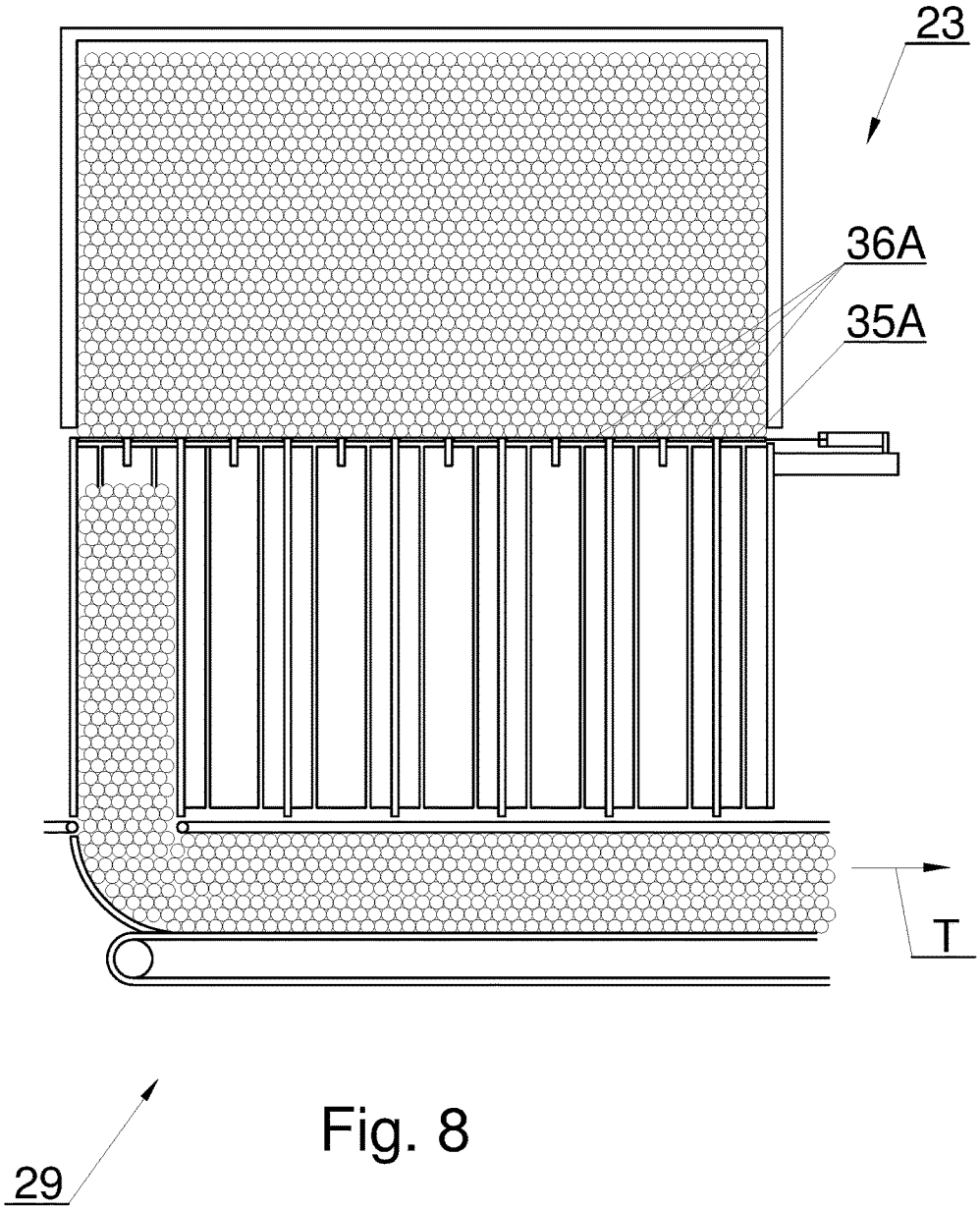
Figure 9:
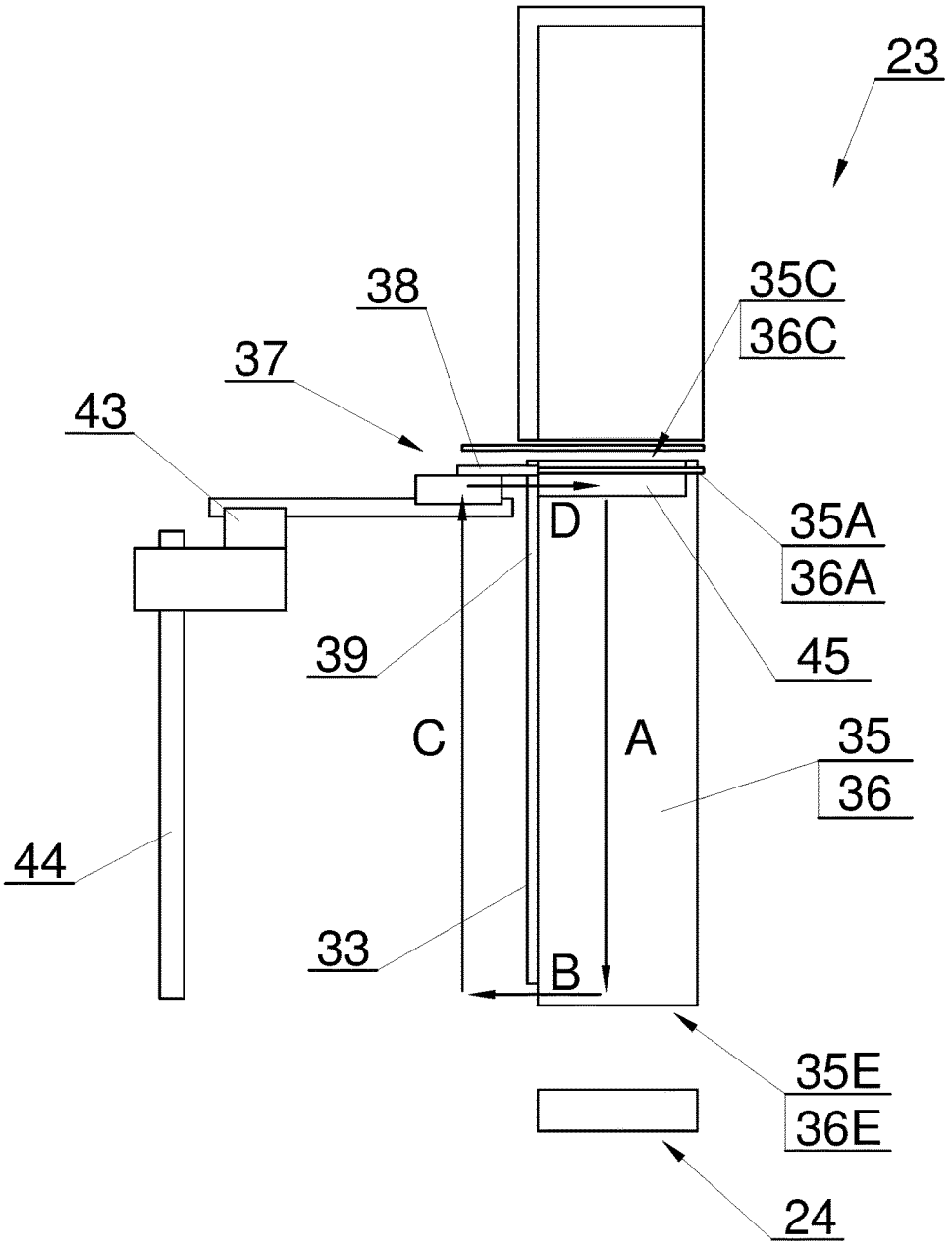
Figure 10:
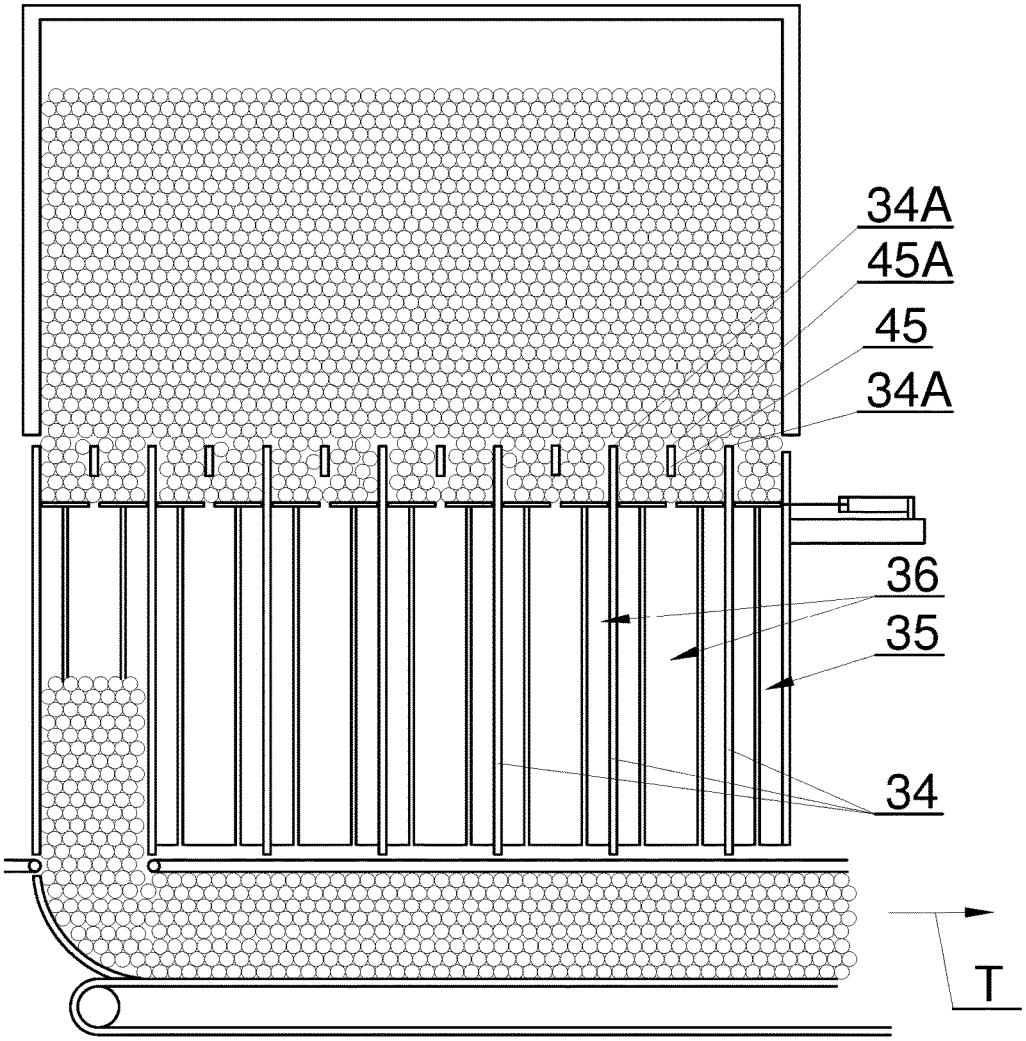
Figure 11:
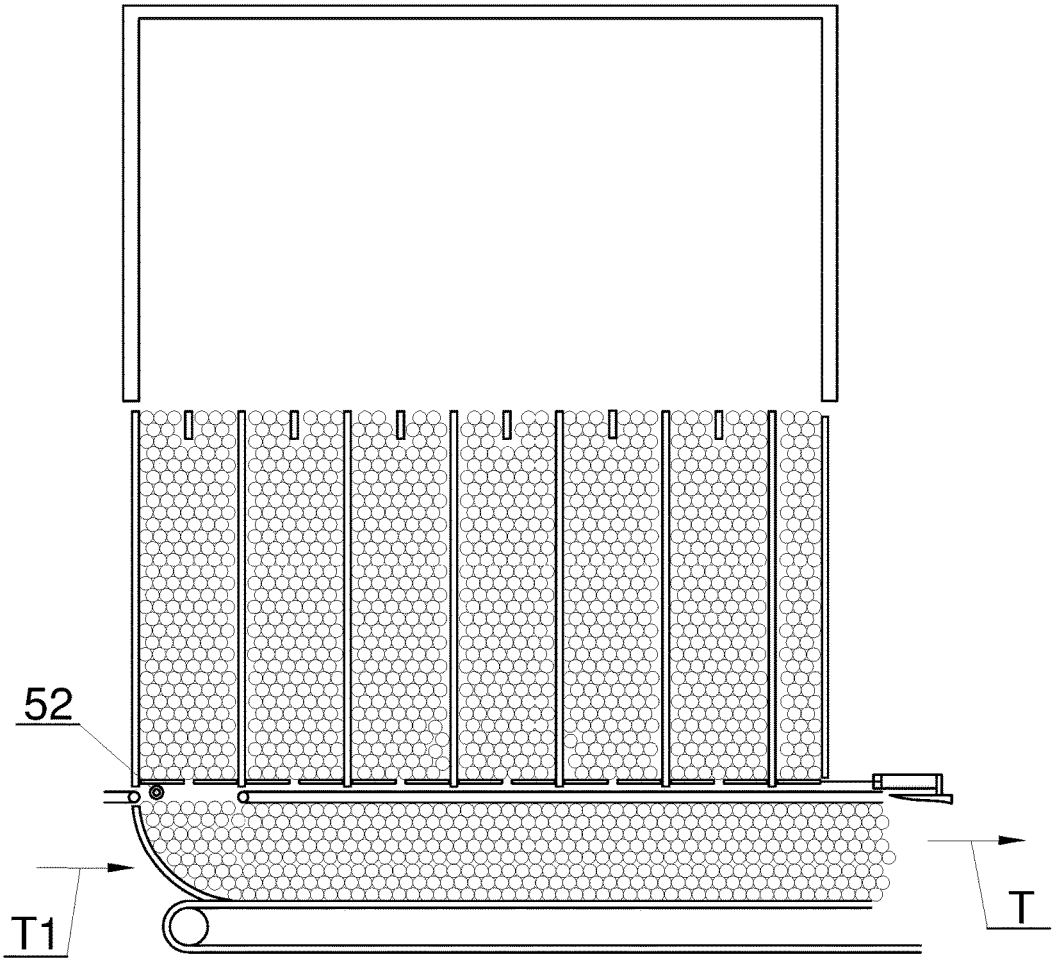
Figure 12:
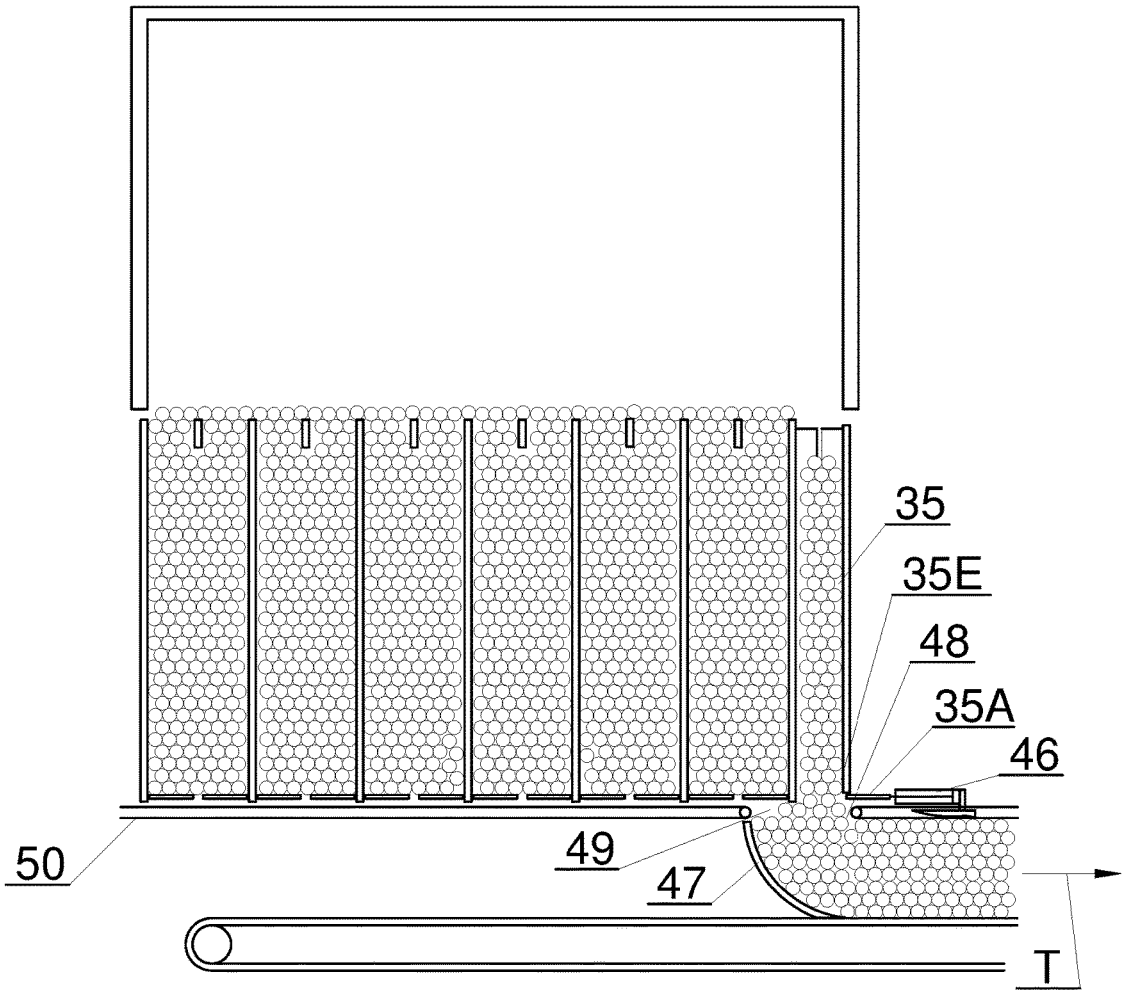
Figure 13:
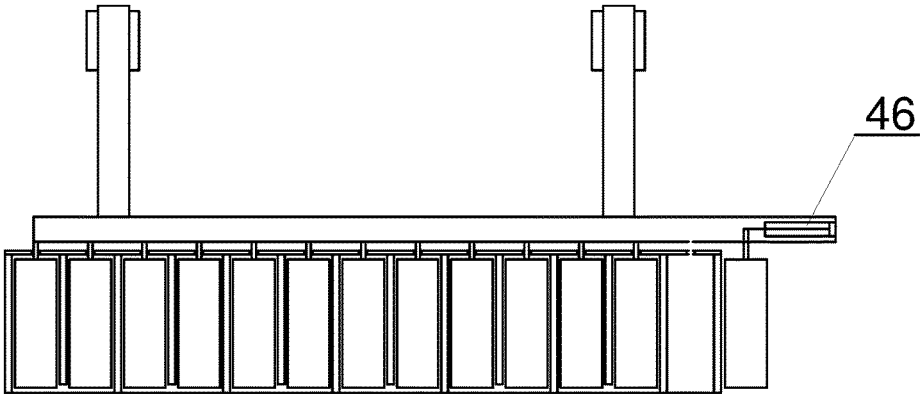
Figure 14:
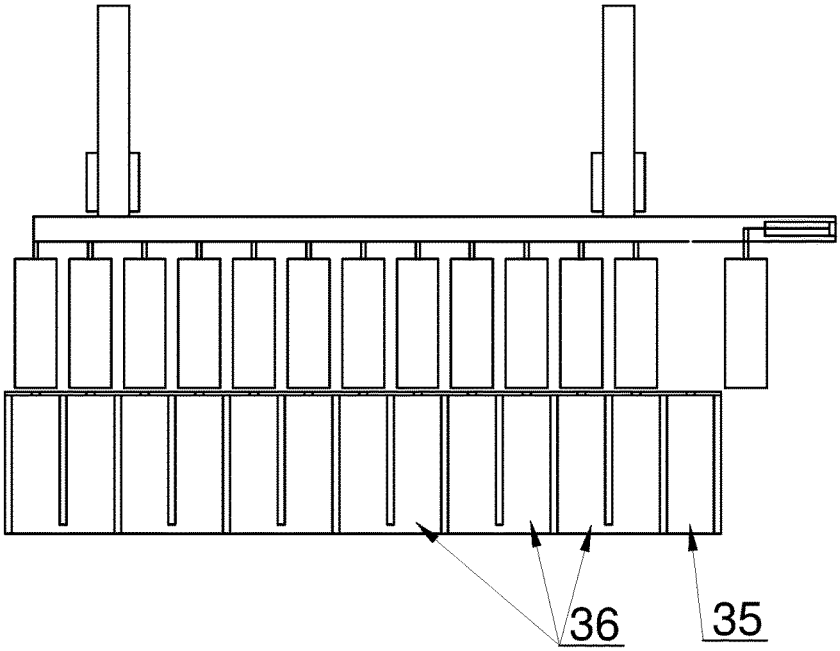
Figure 15:
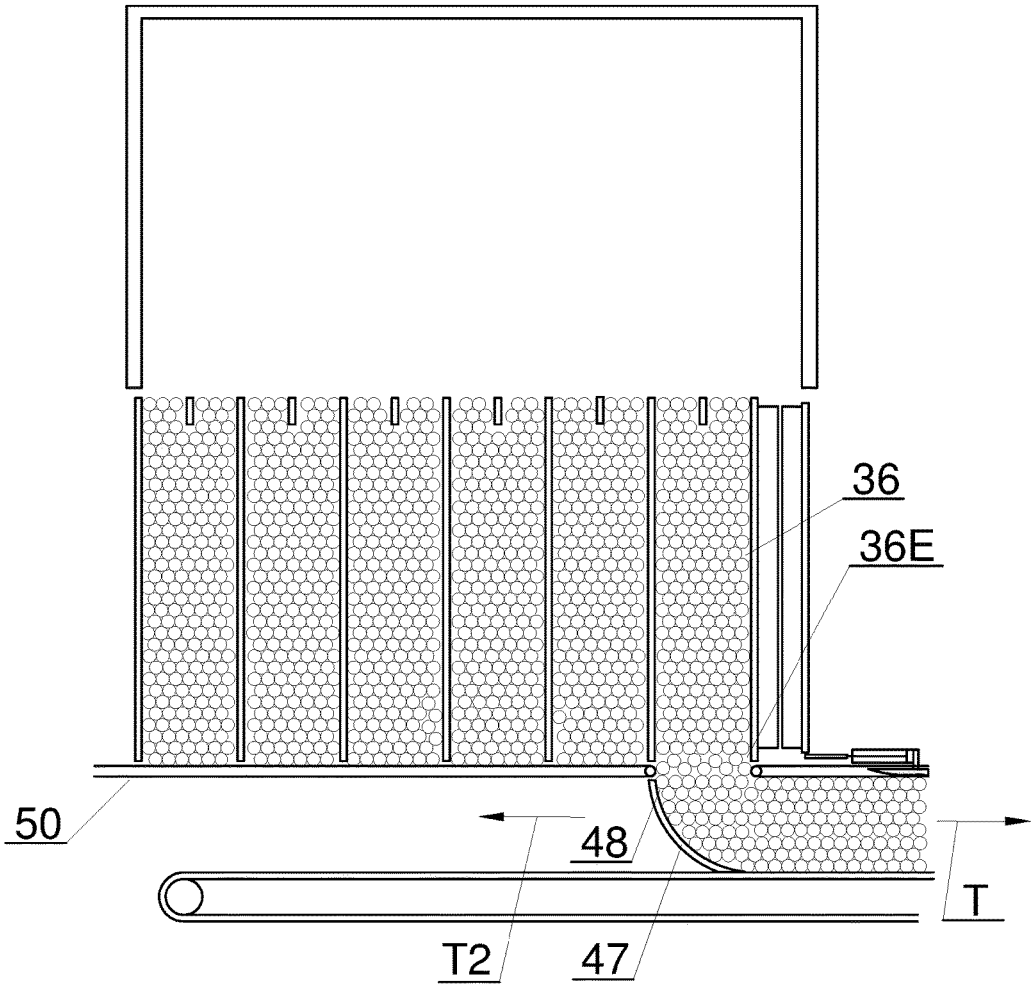
Figure 16:
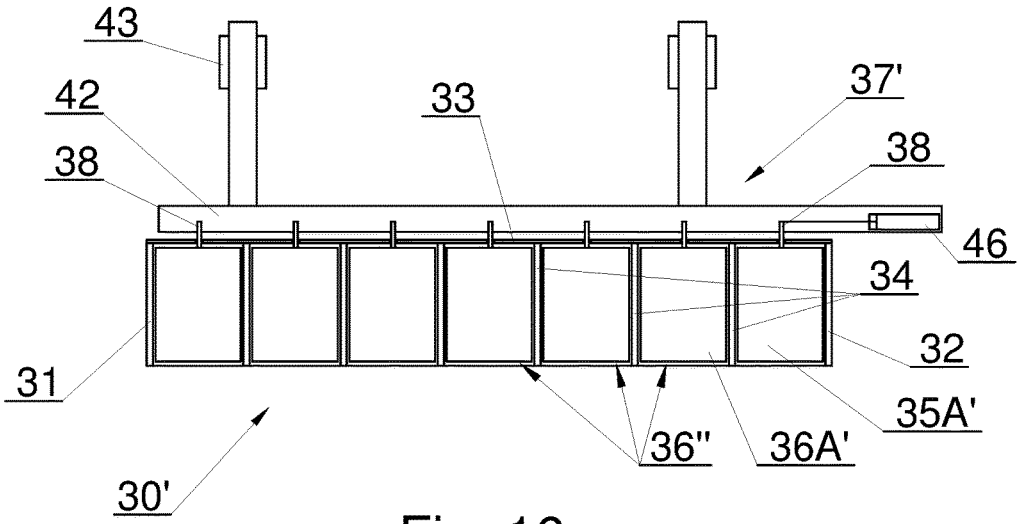

The object of the invention was shown in detail in a preferred embodiment in a drawing in which:

FIG. 1 shows a filled four-wall tray (of the second type) in a perspective view, the front side of the tray being visible, FIG. 2 shows a filled five-wall tray (of the first type) in a perspective view, the front side of the tray being visible, FIG. 2*a* shows a filled five-wall tray (of the first type) in a configuration of the tray of the second type in a perspective view, the back side of the tray being visible, FIG. 2*b* shows a filled five-wall tray (of the first type) in a configuration of the tray of the second type in a perspective view, the front side of the tray being visible, FIG. 3 shows a tray emptying apparatus in a side view, FIG. 4 shows a handling module for transferring of the filled tray to an emptying station, FIG. 5 shows a tray emptying machine in a side view at the moment of feeding of the filled tray to the emptying station, FIG. 6 shows the filled tray emptying station in a front view after the filled tray has been fed, FIG. 7 shows the filled tray emptying station in a top view, FIG. 8 shows the filled tray emptying station in a front view after the damper has been removed, FIG. 9 shows the filled tray emptying station in a side view, the transferring mechanism being in the upper position, FIG. 10 shows the filled tray emptying station in a front view after the feeding of the rod-like articles into the channels of the intermediate hopper has started, FIG. 11 shows the filled tray emptying station in a front view after the rod-like articles have been fed into the channels of the intermediate hopper, FIG. 12 shows the filled tray emptying station in a front view at the moment of emptying of the outermost channel of the intermediate hopper, FIG. 13 shows the filled tray emptying station in a top view after the outermost supporting plate has been removed, FIG. 14 shows the filled tray emptying station in a top view after the transferring element has been withdrawn, FIG. 15 shows the filled tray emptying station in a front view at the moment of emptying of a channel adjacent to the outermost channel of the intermediate hopper, FIG. 16 shows the filled tray emptying station in a top view, the intermediate hopper having channels of an equal width.

In this description, the invention will be described with reference to a four-wall tray 3 shown in a simplified way in FIG. 1 and to a five-wall tray 13 shown in FIG. 2. Both trays 3, 13 were shown as filled in upright position, i.e. in such position in which the filled trays are placed on the filled tray station of the filled tray emptying apparatus. The filled space of the trays was marked by hatching with lines, with only several examples of the rod-like articles R lying at the bottom of the tray. In such upright position, the filled trays are placed by the operator onto the filled tray station, whereas the operator holds the tray by the sidewalls 3L and 3R in such a way that he can see the inside of the tray. Such expressions as upper, bottom, lateral, front and back will refer to the position of the trays shown in FIGS. 1 and 2, with the front side, left lateral side and upper side of each tray being visible therein. The four-wall tray 3 has a bottom wall 3B on which its stands, a back wall 3A and two lateral walls, a left lateral wall 3L and a right lateral wall 3R, whereas the designation of the sides refers to the position in which the tray can be seen by the operator putting a filled tray onto the filled tray station, with the open front side 3G of the trays 3 being directed towards him. The filling and the emptying of the tray takes place through the open side 3T. The four-wall trays may be made of plastic or other suitable material ensuring an adequate rigidity and are usually designed for multiple uses.

The five-wall tray 13 has a bottom wall 13B on which it stands, a back wall 13A and two lateral walls, a left lateral wall 13L and a right lateral wall 13R. The five-wall tray 13 has a swinging upper wall 13T' which is designated as self-aligning relative to the back wall 13A of the tray 13 with which it is connected along the edge 13E. The upper wall 13T' has two swinging lugs, a left swinging lug 13FL and a right swinging lug 13FR which are inserted for the time of transport into the slots in the corresponding lateral walls 13L and 13R. After putting the filled five-wall tray 13 onto the filled tray station, the operator lifts the upper wall 13T' so that the swinging lugs 13FL and 13FR pull out of the walls 13L and 13R and loosely hang down on the side outside the lateral walls 13L and 13R. FIGS. 2*a* and 2*b* show the five-wall tray 13 at a later stage of the emptying cycle of the five-wall tray 13 in an open configuration identical with the configuration of the four-wall tray. The upper wall 13T' is swung so as to allow emptying the five-wall tray 13 through the upper open side 13T of the five-wall tray. The filling of the five-wall tray 13 also takes place through the upper side 13T. Similar to the four-wall tray 3, the operator puts the five-wall tray 13 onto the filled tray station while holding the five-wall tray 13 with the open side 13G directed towards him. Five-wall trays 13 may be made of cardboard or other cheap material, are usually less rigid than the four-wall trays and are usually designed for a single use.

The tray 3, 13 emptying apparatus 1 described below, being a tray unloader, is adapted to empty both four-wall trays 3 and five-wall trays 13. For the sake of simplicity, the units belonging to the tray emptying apparatus 1 according to the invention were shown in FIG. 3 in simplified terms without the drive mechanisms; the outer contour of the body of the apparatus 1 was shown with a dashed line. The tray emptying apparatus 1 is provided with a filled tray station 2 onto which the filled four-wall trays 3 or five-wall trays 13 to be unloaded are placed by the operator. From the filled tray station 2 the trays 3, 13 are fed each the first filled tray 3', 13' in order to deliver them to the lifting unit 6, whereas a plurality of filled trays 3, 13 is collected on the filled tray station 2. At the time of lifting by the lifting unit 6 the tray 3, 13 is held by movable lateral clamping members. The lifting of the tray 3, 13 by the lifting unit 6 may be accomplished by means of any linear movement mechanism with electric or pneumatic drive. The lifting unit 6 lifts the filled tray 3, 13 to a height at which the turning unit 10 shown in FIG. 4 may grip the filled tray 3, 13. The turning unit 10 is adapted to turn the filled tray 3, 13 before unloading it at the filled tray emptying station 23. The turning unit 10 is attached to a rotating shaft 12 with the axis of rotation 12A on a slide 11A of the lifting unit 11. The turning unit 10 and the lifting unit 11 constitute a handling unit 19 (FIG. 4). During the tray 3, 13 emptying cycle the tray 3, 13 is lifted, turned and moved away from the axis of rotation 12A. The tray emptying apparatus 1 is provided with a filled tray emptying station 23 (FIG. 3) in the front part 1A of the apparatus 1 underneath which a discharging conveyor 24 receiving the rod like articles R unloaded from the trays 3, 13 is situated. The filled tray emptying station 23 comprises a feeding apparatus 29 which is provided with an intermediate hopper 30 and a discharging conveyor 24 to discharge the rod-like articles R from the apparatus 1. FIG. 5 shows a situation where the tray 3 is in a position just before unloading, i.e. before transferring the rod-like articles 3 contained in the tray to the intermediate hopper 30, whereas the transfer takes place after positioning the tray directly above the intermediate hopper 30 and withdrawing the damper 18. At the time of emptying the tray 3 may be held by the bottom grippers 15L, 15R and the lateral grippers 16L, 16R. In the back part 1B of the tray emptying apparatus 1, an empty tray station 25 is situated. The tray emptying apparatus 1 was described in detail in the patent application P.417941 belonging to the applicant. The tray emptying apparatus 1 is provided with a controller 40 shown in FIG. 3 connected with individual units of the apparatus 1.

The intermediate hopper 30 shown in FIGS. 6 and 7 has a left sidewall 31 and a right sidewall 32, and a back wall 33. Furthermore, the intermediate hopper 30 has multiple partitions 34 which partition the space of the intermediate hopper 30 into multiple vertical channels 35, 36. The intermediate hopper 30 may be provided with channels of equal or different width, which will be described below. In the embodiment shown (FIG. 6), the outermost vertical channel 35 (on the right side) has a smaller width than the other vertical channels 36, for example smaller by a half. The intermediate hopper 30 in the form of a multi-channel is provided with a transferring element 37 which is mounted slidably relative to the partitions of the intermediate hopper 30 and is used to transfer the mass-flow of the rod-like articles R in individual channels of the intermediate hopper 30 in the downward direction. The transferring element 37 has multiple supporting plates 35A, 36A which are adapted to support the mass-flow of the rod-like articles R in the outermost vertical channel 35 and in the vertical channels 36, whereas for example in each vertical channel 36 two supporting plates 36A are disposed. The supporting plates 35A, 36A are situated horizontally and perpendicular to the back wall 33 of the intermediate hopper 30. The supporting plates 35A, 36A are attached to brackets 38 which pass through vertical slots 39 made in the back wall 33 of the intermediate hopper 30 and are attached to a bearing element 42 horizontally slidable in a guide 43 in the perpendicular direction to the back wall 33 of the intermediate hopper 30. The bracket 38A to which the supporting plate 35A is attached is slidably mounted in a principally parallel direction to the back wall 33. In the shown embodiment, the bracket 38A is attached to an actuator 46. The bracket 38A may be attached to any other element performing a movement with a linear component in the transverse direction to the back wall 33 of the hopper, i.e. move at a certain angle to the back wall 33. The transferring element 37 with the guide 42 is slidably mounted in the vertical direction on the guide 44 shown in FIG. 9. For the sake of simplicity, the drive elements for the horizontal and vertical movement were not shown. The supporting plates 35A, 36A of the transferring element 37 may be inserted into the vertical channels 35, 36 through the upper cut-outs 35B, 36B at the inlets 35C, 36C of the channels. The supporting plates 35A, 36A may be pulled out of the vertical channels 35, 36 through the bottom cut-outs 35D, 36D at the outlets 35E, 36E of the channels. In the inlets 35C, 36C, there are additional partitions 45 situated at half width of the vertical channels 36, whereas the additional partitions 45 are situated between the supporting plates 36A at the moment when the other supporting plates 36A are situated in the inlet 36C of the channel.

The working cycle of the supporting plates 35A, 36A was shown in FIG. 9 by the arrows (A, B, C, D). The supporting plates 35A, 36A perform a movement in the vertical direction downwards (A) at the time of transferring of the mass-flow downwards in the channels 35, 36, then the supporting plates 35A, 36A perform a movement in the horizontal direction backwards (B) and are pulled out of the channels 35, 36, after which they move in the vertical direction upwards (C) outside the vertical channels 35, 36, and then they perform a movement in the horizontal direction forwards (D) and are inserted into the vertical channels 35, 36 (D).

Underneath the intermediate hopper 30 there is a receiving conveyor 24 which is provided with a slidable chute 47 which is used to transfer the mass-flow of the rod-like articles R from the vertical channels 35, 36 onto the discharging conveyor 24 which discharges the rod-like articles R received from the vertical channels to the 35, 36 intermediate hopper 30 in the discharging direction T, whereas the chute 47 has a separate drive (not shown) and is adapted to move relative to the receiving conveyor 24. Above the inlet 48 of the chute 47 there is a passage 49 formed by a tape 50, 51.

FIG. 6 shows a filled tray emptying station 23 at the moment just after a filled tray 3 has been placed in it, whereas a damper 18 which shuts the rod-like articles R in the tray 3 has not yet been withdrawn. In such position, the tray 3 waits until the moment of at least partial emptying of all channels 35, 36, with the whole vertical channel 36' being still filled. After the withdrawal of the damper 18, the rod-like articles R collected in the tray 3 fall onto the supporting plates 35A, 36A of the transferring element 37, which was shown in FIG. 8. After falling of the rod-like articles R, the transferring element 37 starts a movement downwards (A) so that the rod-like articles R are fed into the vertical channels 35, 36, which was shown in FIG. 10. The rod-like articles R in the tray 3 are usually arranged perpendicular to the back wall 3A. Where the individual rod-like articles R are arranged slantwise i.e. not perpendicular to the back wall, the upper edges 34A of the partitions 34 and the upper edges 45A of the additional partitions 45 force the movement of the articles during the flow downwards so that they are positioned parallel to the other articles R in the mass-flow of the rod-like articles R in the vertical channels 35, 36. FIG. 11 shows the moment where all rod-like articles R from the vertical channel 36' have been fed into the chute 47 through the passage 49, and the absence of the rod-like articles R in the passage 49 is detected by means of a detector 52. The signal of absence of the rod-like articles R in the passage 49 is a signal to start the movement of the chute 47 in the direction T1 (FIG. 11) corresponding to the direction T of discharge of the mass flow of the rod-like articles R on the conveyor 24, whereas the speed of movement of the mass-flow on the conveyor 24 and the speed of movement of the chute 47 are equal. The chute 47 movement speed selected this way ensures that a constant level of rods in the inlet 48 during the movement of the chute 47 is maintained. At the moment when the inlet 48 of the chute 47 is situated underneath the outlet 35E of the outermost vertical channel 35 (FIG. 12), the outermost supporting plate 35A is slid open by means of the actuator 46 according to the direction T of discharge (see also in FIG. 13), after which the rod-like articles R from the vertical channel 35 start flowing through the passage 49 and joining the mass-flow on the discharging conveyor 24. At the time of conveying of the rod-like articles R from the outermost vertical channel 35, all supporting plates 35A, 36A of the transferring element 37 are withdrawn in the perpendicular direction to the direction T of discharge, whereas FIG. 14 shows the transferring element 37 after the withdrawal. After the withdrawal of the supporting plates 35A, 36A, the rod-like articles R being in the vertical channels 36 are supported on the tape 50 or another support element. After conveying all rod-like articles R from the vertical channel 35, which is detected by means of the detector 52 which moves along with the chute 47, the chute moves in accordance with the direction T2 so that the inlet 48 of the chute 47 is situated underneath the outlet 36E of the vertical channel 36. The successive vertical channels 36 of the intermediate hopper 30 are emptied in the same way. The positioning of the inlet 48 of the chute 47 and then the transferring of the chute 47 to the successive vertical channel (36) mat be accompanied by the movement of the intermediate hopper (30) as described in the patent EP 2 079 327 B1.

The movement of the outermost supporting plate 35A of the transferring element 37 may take place in the transverse direction to the direction of movement of the other supporting plates 36A. It is also possible to adapt the mechanisms of the apparatus 1 in such a way that the outermost supporting plate 35A will make a movement in at least two directions relative to the other supporting plates 36A of the transferring element 37. Such solution appears to be more complicated, however in some configurations it is just as useful as the solution wherein the outermost supporting plate 35A performs only a transverse movement relative to the other supporting plates 36A of the transferring element 37.

FIG. 16 shows the intermediate hopper 30' provided with the vertical channels 36" of equal widths in which the other supporting plates 36A', also of equal widths, belonging to the transferring element 37' are moving. The outermost supporting plate 35A' may have a greater width than the other supporting plates 36A'. The operation of the intermediate hopper 30' is similar to the previously described intermediate hopper 30.

The invention claimed is:

1. An intermediate hopper (30) in a tobacco industry apparatus (1) for vertical conveying of a mass-flow of rod-like articles (R), the intermediate hopper (30) comprising sidewalls (31, 32) and multiple partitions (34) partitioning the intermediate hopper (30) into vertical channels (35, 36) which are adapted to receive the rod-like articles (R) from a tray (3, 13) positioned above an upper side of the intermediate hopper (30), whereas the intermediate hopper (30) is provided with a movable transferring element (37) being slidable relative to the partitions (34) of the intermediate hopper (30), in addition the transferring element (37) is built of supporting plates (35A, 36A) which support the mass-flow of the rod-like articles (R) in vertical channels (35, 36) of the intermediate hopper (30) above the supporting plates (35A, 36A), whereas the supporting plates (35A, 36A) are adapted to move downwards (A) within the vertical channels (35, 36) and to move upwards (C) outside the vertical channels (35, 36), the supporting plates (35A, 36A) being further adapted to be inserted into the channels (35, 36) in an area of channel inlets (35C, 36C) and to be pulled out of the vertical channels (35, 36) in an area of channel outlets (35E, 36E), characterised in that at least an outermost supporting plate (35A) of the transferring element (37) is adapted to make a movement in a direction transverse to a direction of movement of other supporting plates (36A).

2. The intermediate hopper (30) as in claim 1 characterised in that the outermost supporting plate (35A) of an outermost vertical channel (35) is slidable in at least two directions relative to the other supporting plates (36A) of the transferring element (37).

3. The intermediate hopper (30) as in claim 1 characterised in that in the inlets (36C) of the vertical channels (36) additional partitions (45) are situated, whereas between the other supporting plates (36A) of the transferring element (37) situated in the same channel (36) there is a slot receiving the additional partitions (45).

4. The intermediate hopper (30) as in claim 1 characterised in that an outermost vertical channel (35) of the intermediate hopper (30) has a smaller width than any of the other vertical channels (36) of the intermediate hopper (30).

5. The intermediate hopper (30) as in claim 1 characterised in that an outermost vertical channel (35) of the intermediate hopper (30) has a greater width than any of the other channels (36) of the intermediate hopper (30).

6. The intermediate hopper (30) as in claim 1 characterised in that an outermost channel (35) of the intermediate hopper (30) has a width equal to the width of the other channels (36) of the intermediate hopper (30).

7. A feeding apparatus (29) for feeding with rod-like articles (R) of the tobacco industry in a tobacco industry apparatus (1), and for vertical conveying of a mass-flow of the rod-like articles (R) comprising:

an intermediate hopper (30) comprising sidewalls (31, 32) and multiple partitions (34) partitioning the intermediate hopper into vertical channels (35, 36) which are adapted to receive the rod-like articles (R) from a tray (3, 13) positioned above an upper side of the intermediate hopper (30), whereas the intermediate hopper (30) is provided with a movable transferring element (37) being slidable relative to the partitions (34) of the intermediate hopper (30), in addition, the transferring element (37) is built of supporting plates (35A, 36A) which support the mass-flow of the rod-like articles (R) in the vertical channels (35, 36) of the intermediate hopper (30) above the supporting plates (35A, 36A), whereas the supporting plates (35A, 36A) are adapted to move downwards (A) within the channels (35, 36) and to move upwards (C) outside the channels (35, 36), the supporting plates (35A, 36A) being further adapted to be inserted into the channels (35, 36) in an area of the channel inlets (35C, 36C) and to be pulled out of the channels in an area of the channel outlets (35E, 36E), whereas at least an outmost supporting plate (35A) is adapted to make a movement in a transverse direction to a direction of movement of other supporting plates (36A), the feeding apparatus (29) being further provided with a discharging conveyor (24) to discharge the mass-flow of the rod-like articles (R) from the vertical channels (35, 36) of the intermediate hopper (30), a tape (50) to close and open the outlets (35E, 36E) of the channels of the intermediate hopper (30), and a chute (47) having a flow connection with the discharging conveyor (24), the chute (47) being slidable and adapted to receive the mass-flow of the rod-like articles (R) from the outlets (35E, 36E) of the channels of the intermediate hopper (30), characterised in that the outermost supporting plate (35A) of the outermost vertical channel (35) of the intermediate hopper (30) is adapted so that it slides open in the direction corresponding to the direction (T) of discharge of the mass-flow of the rod-like articles (R) by the discharging conveyor (24) from the intermediate hopper (30).

8. The feeding apparatus as in claim 7 characterised in that the outermost supporting plate (35A) of the outermost vertical channel (35) of the intermediate hopper (30) is slidable in at least two directions relative to the other supporting plates (36A) of the transferring element (37).

9. The feeding apparatus as in claim 7 characterised in that the plates (36A) supporting the mass-flow of the rod-like articles (R) in the other vertical channels (36) are adapted to slide open in a perpendicular direction to the direction (T) of discharge of the mass-flow of the rod-like articles (R) from the intermediate hopper (30).

10. An apparatus (1) for emptying of a tray (3, 13) filled with the rod-like articles (R) of the tobacco industry comprising:

a filled tray station (2), a filled tray lifting unit (6), a turning unit (10), a filled tray emptying station (23), an empty tray station (25), characterised in that the filled tray emptying station (23) is provided with a feeding apparatus (29) as in claim 7.

* * * * *